US012509854B2

(12) United States Patent
Horii

(10) Patent No.: US 12,509,854 B2
(45) Date of Patent: Dec. 30, 2025

(54) WORKING VEHICLE

(71) Applicant: KUBOTA CORPORATION, Osaka (JP)

(72) Inventor: Hiroshi Horii, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 821 days.

(21) Appl. No.: 17/836,111

(22) Filed: Jun. 9, 2022

(65) Prior Publication Data

US 2022/0298744 A1 Sep. 22, 2022

Related U.S. Application Data

(63) Continuation of application No. PCT/JP2020/048354, filed on Dec. 24, 2020.

(30) Foreign Application Priority Data

Dec. 27, 2019 (JP) ..... 2019-238288

(51) Int. Cl.
*E02F 9/20* (2006.01)
*E02F 3/43* (2006.01)
*E02F 3/96* (2006.01)

(52) U.S. Cl.
CPC ..... *E02F 9/2033* (2013.01); *E02F 3/435* (2013.01); *E02F 3/964* (2013.01)

(58) Field of Classification Search
CPC ..... E02F 9/2033; E02F 3/435; E02F 3/964; E02F 3/43; E02F 9/2037; E02F 9/2041; E02F 3/431
See application file for complete search history.

(56) References Cited

U.S. PATENT DOCUMENTS 7,852,229 B1 * 12/2010 Gohl ..... E02F 9/2033 340/685
2009/0030580 A1 * 1/2009 Doi ..... E02F 9/2033 701/50

(Continued)

FOREIGN PATENT DOCUMENTS

JP 7-243225 A 9/1995
JP 11-93199 A 4/1999

(Continued)

OTHER PUBLICATIONS

International Search Report and Written Opinion of the International Searching Authority issued in International Patent Application No. PCT/JP/2020/048354, dated Mar. 9, 2021, along with an English translation thereof.

*Primary Examiner* — Christopher J Sebesta
*Assistant Examiner* — Blake E Scoville
(74) *Attorney, Agent, or Firm* — GREENBLUM & BERNSTEIN, P.L.C.

(57) ABSTRACT

A working machine includes a machine body, a dozer, a boom, an arm, a working tool, a boom cylinder, and an arm cylinder. The working machine also includes an arm crowd restricting unit and a crowd restriction releasing unit. The arm crowd restricting unit imposes a restriction on a stroke of the arm cylinder in an arm crowd direction so that a swing track of a distal end portion of the working tool is spaced from the boom cylinder. The crowd restriction releasing unit releases the restriction on the stroke of the arm cylinder to enable the arm to swing to an end of a swing range in the arm crowd direction when the boom is at a swing position at which the working tool in an operating position close to a working-tool dump position is disposed in a vicinity of a blade.

7 Claims, 8 Drawing Sheets

(56) References Cited

U.S. PATENT DOCUMENTS

| | | | | |
|---|---|---|---|---|
| 2011/0264334 | A1* | 10/2011 | Murota | E02F 9/2033 701/50 |
| 2015/0147147 | A1* | 5/2015 | Uchiyama | E02F 9/2033 414/685 |
| 2018/0119383 | A1* | 5/2018 | Glasser | E02F 9/121 |
| 2018/0266071 | A1* | 9/2018 | Matsuyama | E02F 9/2004 |
| 2020/0354920 | A1 | 11/2020 | Horii | |

FOREIGN PATENT DOCUMENTS

| | | | |
|---|---|---|---|
| JP | 2017-65569 | A | 4/2017 |
| WO | 2019/146206 | A1 | 8/2019 |

* cited by examiner

WORKING VEHICLE

CROSS REFERENCE TO RELATED APPLICATIONS

This application is a continuation application of International Application No. PCT/JP2020/048354, filed on Dec. 24, 2020, which claims the benefit of priority to Japanese Patent Application No. 2019-238288, filed on Dec. 27, 2019. The entire contents of each of these applications are hereby incorporated herein by reference.

BACKGROUND OF THE INVENTION

1. Field of the Invention

The present invention relates to a working machine.

2. Description of the Related Art

A working machine disclosed in Japanese Unexamined Patent Application Publication No. 2017-65569 is known.

The working machine disclosed in Japanese Unexamined Patent Application Publication No. 2017-65569 is a backhoe including a machine body, a dozer, a boom, an arm, and a bucket. This working machine is capable of swinging the boom, the arm, and the bucket by extending and retracting a boom cylinder, an arm cylinder, and a bucket cylinder, respectively.

SUMMARY OF THE INVENTION

In the working machine according to the related art, the arm cylinder has a stroke length set to prevent the bucket from coming into contact with the boom cylinder.

Therefore, according to the working machine of the related art, it may not be possible to bring a distal end portion of the bucket sufficiently close to a blade of the dozer by performing an operation of moving the distal end portion of the bucket toward the blade of the dozer.

In light of the above-described problem, an object of the present invention is to provide a working machine capable of bringing a distal end portion of a working tool sufficiently close to a blade of a dozer.

A working machine according to an embodiment of the present invention includes a machine body, a dozer, a boom, an arm, a working tool, a boom cylinder, an arm cylinder, an arm crowd restricting unit, and a crowd restriction releasing unit. The dozer includes a blade. The boom is pivotably supported by the machine body such that the boom is swingable upward and downward. The arm is pivotably supported by the boom such that the arm is swingable in an arm crowd direction toward the boom and an arm dump direction away from the boom. The working tool is pivotably supported by a pivot on the arm such that the working tool is swingable about the pivot between a working-tool crowd position at which a distal end portion of the working tool is closest to the arm and a working-tool dump position at which the distal end portion of the working tool is farthest from the arm. The boom cylinder causes the boom to swing. The arm cylinder causes the arm to swing in the arm crowd direction and the arm dump direction. The arm crowd restricting unit imposes a restriction on a stroke of the arm cylinder in the arm crowd direction so that a swing track of the distal end portion of the working tool is spaced from the boom cylinder. The crowd restriction releasing unit releases the restriction on the stroke of the arm cylinder to enable the arm to swing to an end of a swing range in the arm crowd direction when the boom is at a swing position at which the working tool in an operating position close to the working-tool dump position is disposed in a vicinity of the blade.

The working machine may further include a working-tool crowd restricting unit that restricts swinging of the working tool in a direction toward the working-tool crowd position when the restriction on the stroke is released by the crowd restriction releasing unit.

The working machine may further include a boom controller that controls swinging of the boom. When the boom is raised from a first swing position, at which a gap between the distal end portion of the working tool and the blade is at a minimum, to a second swing position by a predetermined angle while the restriction on the stroke is released by the crowd restriction releasing unit, the boom controller may stop raising of the boom until the arm returns to a region in which the stroke of the arm cylinder is not restricted.

The working machine may further include an arm controller that controls swinging of the arm. When the boom is raised from a first swing position, at which a gap between the distal end portion of the working tool and the blade is at a minimum, to a second swing position by a predetermined angle while the restriction on the stroke is released by the crowd restriction releasing unit, the arm controller may control the arm to return the arm to a region in which the stroke of the arm cylinder is not restricted.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
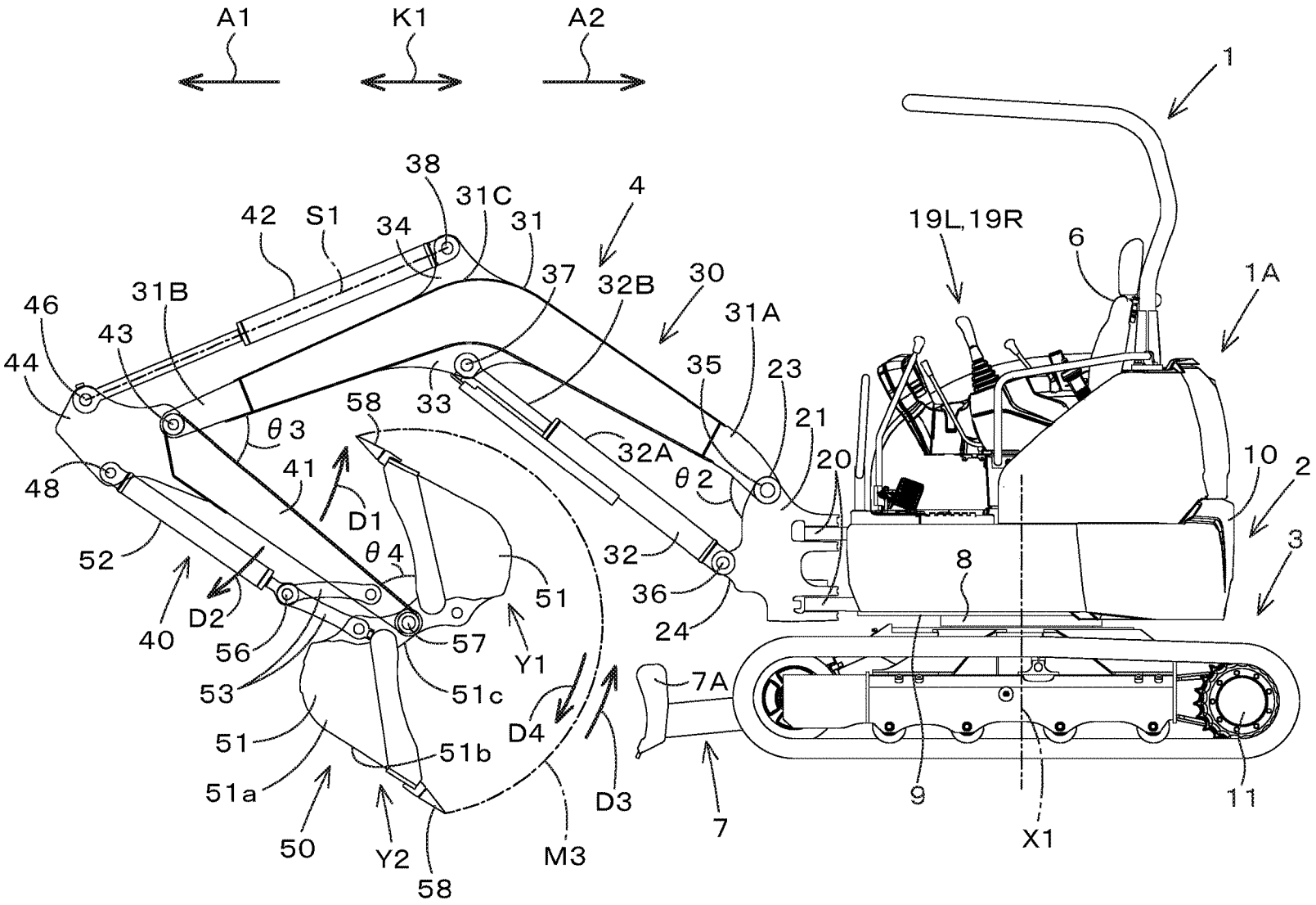
FIG. 1 is a side view of a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

An embodiment of the present invention will now be described with reference to the drawings.

FIG. 1 is a schematic side view of a working machine 1 according to the present embodiment. In the present embodiment, the working machine 1 is a backhoe, which is a swiveling working machine.

As illustrated in FIG. 1, the working machine 1 includes a traveling body 1A and a working device 4 mounted on the traveling body 1A. The traveling body 1A includes a traveling device 3 and a machine body (swivel base) 2 mounted on the traveling device 3. An operator's seat 6, on which an operator sits, is mounted on the machine body 2.

In the present embodiment, a forward direction with respect to the operator on the operator's seat 6 (direction of arrow A1 in FIG. 1) will be referred to as forward, a rearward direction with respect to the operator (direction of arrow A2 in FIG. 1) as rearward, a leftward direction with respect to the operator (direction coming out of the page in FIG. 1) as leftward, and a rightward direction with respect to the operator (direction going into the page in FIG. 1) as rightward. A horizontal direction orthogonal to a front-rear direction K1 will be referred to as a machine-body width direction (width direction of the machine body 2). A leftward or rightward direction with respect to the center of the machine body 2 in the width direction will be referred to as a machine-body outward direction (outward direction along the machine-body width direction K2). In other words, the machine-body outward direction is a direction away from the center of the machine body 2 in the width direction along the machine-body width direction K2. A direction opposite to the machine-body outward direction will be referred to as a machine-body inward direction (inward direction along the machine-body width direction). In other words, the machine-body inward direction is a direction toward the center of the machine body 2 in the width direction along the machine-body width direction.

Referring to FIG. 1, the traveling device 3 is capable of traveling while supporting the machine body 2. The traveling device 3 is driven by a traveling motor 11 that is, for example, a hydraulic motor (hydraulic actuator) or an electric motor. In the present embodiment, the traveling device 3 is a crawler traveling device. However, the traveling device 3 is not limited to this, and may instead be, for example, a wheel traveling device.

A dozer 7 is attached to the front of the traveling device 3. The dozer 7 is capable of raising and lowering a blade (earth removing plate) 7A by extending and retracting a dozer cylinder (hydraulic actuator) that is not illustrated.

The machine body 2 is supported by a swivel bearing 8 on the traveling device 3 such that the machine body 2 is capable of swiveling about a swivel axis X1. The swivel axis X1 is an axis that extends vertically through the center of the swivel bearing 8. A prime mover is mounted in the machine body 2. The prime mover is a diesel engine. The prime mover may instead be a gasoline engine, an electric motor, or a hybrid prime mover including both an engine and an electric motor.

The machine body 2 includes a swivel plate 9 that swivels about the swivel axis X1. The swivel plate 9 is formed of, for example, a steel plate, and constitutes a bottom portion of the machine body 2. The prime mover is mounted on the swivel plate 9. A weight 10 is provided at the rear of the machine body 2.

Support brackets 20 that support a working device 4 and a swing bracket 21 are provided at the front of the machine body 2. The support brackets 20 project forward from the machine body 2. The swing bracket 21 is attached to front portions of the support brackets 20 (portions projecting from the machine body 2) by a swing shaft such that the swing bracket 21 is swingable about a vertical axis (axis that extends vertically). Accordingly, the swing bracket 21 is rotatable in the machine-body width direction (horizontally around the swing shaft).

The working device 4 includes a boom device 30, an arm device 40, and a working tool device 50. The boom device 30 includes a boom 31 and a boom cylinder 32. The boom 31 includes a proximal portion 31A, a distal end portion 31B, and an intermediate portion 31C. The proximal portion 31A is supported in a swingable (rotatable) manner by a horizontal shaft 35 that extends in the machine-body width direction on a first pivotal support 23 of the swing bracket 21. The distal end portion 31B supports an arm 41 in a swingable manner. The intermediate portion 31C is provided between the proximal portion 31A and the distal end portion 31B. The intermediate portion 31C is elongated in a longitudinal direction, and is bent downward at an intermediate position thereof. A lower bracket 33 is provided on one side (lower side) of the bent portion of the intermediate portion 31C, and an upper bracket 34 is provided on the other side (upper side) of the bent portion of the intermediate portion 31C.

The boom cylinder 32 is an extendable-retractable hydraulic cylinder that swings (rotates) the boom 31 and includes a tubular cylinder unit 32A and a rod 32B having one end slidably inserted in the cylinder unit 32A. The boom cylinder 32 is disposed adjacent to a surface of the boom 31 that faces the arm 41 when the arm 41 swings in an arm crowd direction Dl. In other words, the boom cylinder 32 is disposed below the front surface of the boom 31. A proximal end portion of the boom cylinder 32 is supported in a swingable manner by a horizontal shaft 36 on a second pivotal support 24 of the swing bracket 21. A distal end portion of the boom cylinder 32 is supported in a swingable manner by a horizontal shaft 35 on the lower bracket 33. Accordingly, the boom device 30 (boom 31) is rotatable around the horizontal shaft 35 on the first pivotal support 23, so that the boom device 30 (boom 31) is swingable upward or downward. A guard member (cylinder guard) for preventing the rod 32B and/or the cylinder unit 32A from coming into contact with another object may be provided on a surface of the boom cylinder 32 that faces the arm 41 (lower surface).

The arm device 40 includes the arm 41 and an arm cylinder 42. The arm 41 is elongated in a longitudinal direction. A proximal end portion of the arm 41 is supported in a swingable manner by a horizontal shaft 43 on the distal end portion 31B of the boom 31. An upper bracket 44 is provided on an upper surface of the proximal end portion of the arm 41.

The arm cylinder 42 is an extendable-retractable hydraulic cylinder that swings the arm 41. A proximal end portion of the arm cylinder 42 is supported in a swingable manner by a horizontal shaft 38 on the upper bracket 34 of the boom 31. A distal end portion of the arm cylinder 42 is supported in a swingable manner by a horizontal shaft 46 on the upper bracket 44. Accordingly, the arm device 40 (arm 41) is rotatable around the horizontal shaft 43 on the boom 31, so that the arm device 40 (arm 41) is swingable upward or downward (forward or rearward). More specifically, as illustrated in FIG. 1, the arm 41 is pivotably supported by the boom 31 such that the arm 41 is swingable in the arm crowd direction D1 toward the boom 31 and an arm dump direction D2 away from the boom 31. According to the present embodiment, the arm cylinder 42 is extended (stroked in the arm crowd direction D1) to swing the arm 41 in the arm crowd direction D1. The arm cylinder 42 is retracted (stroked in the arm dump direction D2) to swing the arm 41 in the arm dump direction D2.

The working tool device 50 includes a bucket 51 that serves as a working tool and a bucket cylinder 52 that serves as a working tool cylinder. The bucket 51 is supported in a swingable manner by a pivot 57 on a distal end portion of the arm 41. A link mechanism 53 is provided between the bucket 51 and the distal end portion of the arm 41. The bucket 51 includes a bucket body 51*a* that scoops the earth or other materials and an attachment bracket 51*c* that is attached to the arm 41 and the link mechanism 53. The bucket body 51*a* includes a bottom surface 51*b* and a distal end portion (lug portion) 58.

The bucket cylinder 52 is an extendable-retractable hydraulic cylinder that swings the bucket 51. A proximal end portion of the bucket cylinder 52 is supported in a swingable manner by a horizontal shaft 48 on the upper bracket 44 of the arm 41. A distal end portion of the bucket cylinder 52 is supported in a swingable manner by a horizontal shaft 56 on the link mechanism 53. Thus, the working tool device 50 (bucket 51) is provided at the distal end of the arm 41 and is capable of performing a crowding operation (shoveling operation) and a dumping operation. The crowding operation (shoveling operation) is an operation of moving the distal end portion 58 of the bucket 51 in a bucket crowd direction (working-tool crowd direction), which is a direction toward the boom 31 (arm 41), and is performed to, for example, scoop the earth or other materials. The dumping operation is an operation of moving the distal end portion 58 of the bucket 51 in a bucket dump direction (working-tool dump direction), which is a direction away from the boom 31 (arm 41), and is performed to, for example, drop (discharge) the earth or other materials that have been scooped.

Thus, as illustrated in FIG. 1, the bucket 51 is swingable between a bucket crowd position (working-tool crowd position) Y1, at which the bucket cylinder 52 is maximally extended (maximally stroked in a bucket crowd direction D3) and at which the distal end portion 58 is closest to the arm 41, and a bucket dump position (working-tool dump position) Y2, at which the bucket cylinder 52 is maximally retracted (maximally stroked in a bucket dump direction D4) and at which the distal end portion 58 is farthest from the arm 41. In FIG. 1, M3 denotes a swing track of the distal end portion 58 when the bucket 51 moves between the bucket crowd position Y1 and the bucket dump position Y2.

A working tool (hydraulic attachment) other than the bucket 51 that can be driven by a hydraulic actuator may be attached to the working machine 1 in place of or in addition to the bucket 51. The other working tool may be, for example, a hydraulic breaker, a hydraulic crusher, an angle broom, an earth auger, a pallet fork, a sweeper, a mower, or a snow blower.

Figure 2:
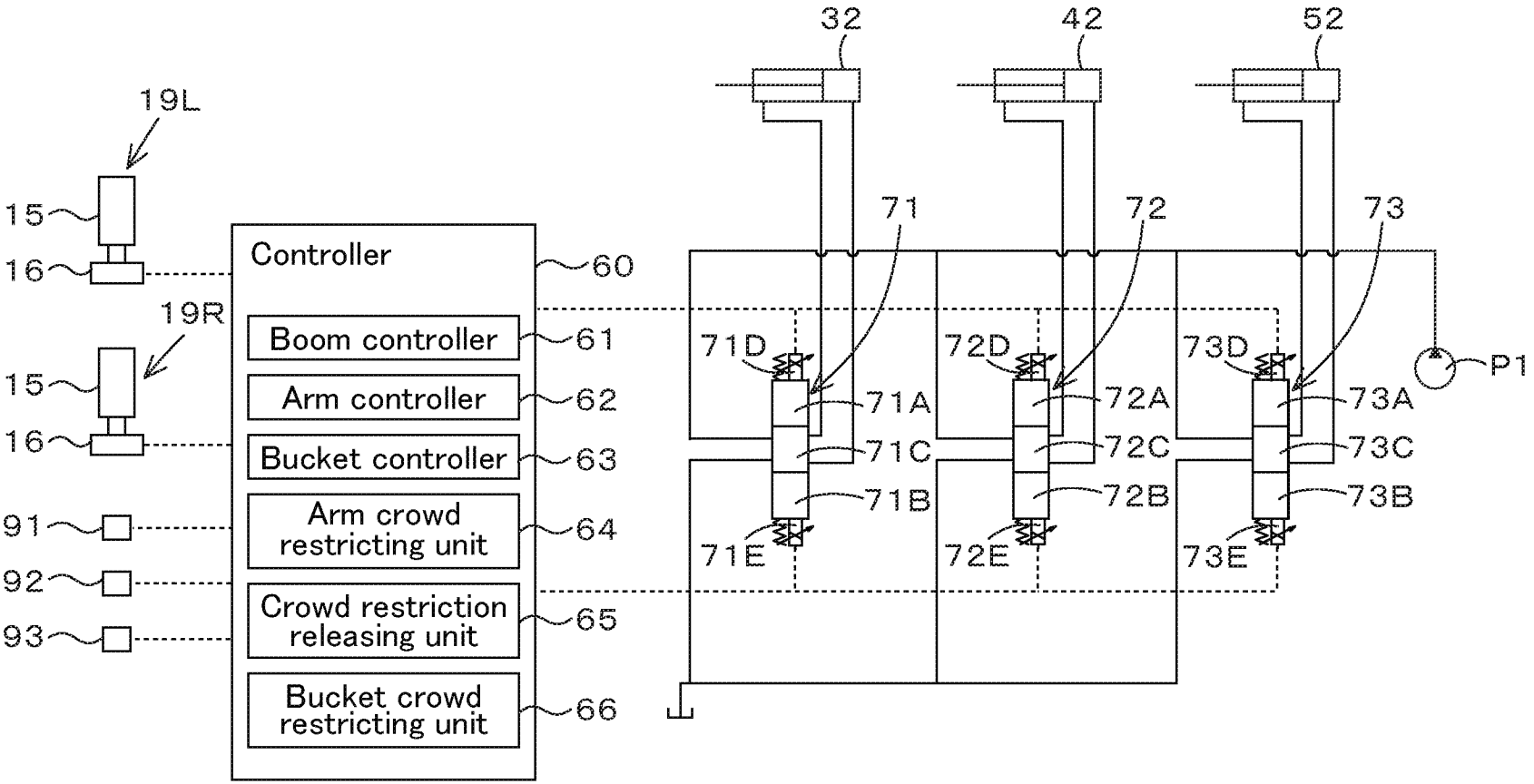
FIG. 2 illustrates a hydraulic system of the working machine.

FIG. 2 illustrates a hydraulic system of the working machine 1 that activates the working device 4.

As illustrated in FIG. 2, the hydraulic system of the working machine 1 includes a boom control valve 71, an arm control valve 72, a bucket control valve 73, a controller 60, operation devices 19L and 19R, a boom angle sensor 91, an arm angle sensor 92, and a working-tool angle sensor 93.

The boom control valve 71, the arm control valve 72, and the bucket control valve 73 are respectively connected to the boom cylinder 32, the arm cylinder 42, and the bucket cylinder 52 by fluid passages. The boom control valve 71, the arm control valve 72, and the bucket control valve 73 are connected to a hydraulic pump P1, which outputs hydraulic fluid, by fluid passages.

The boom control valve 71, the arm control valve 72, and the bucket control valve 73 are, for example, electromagnetic three-position switching valves.

More specifically, the boom control valve 71 is a direct-operated spool-type switching valve capable of switching between a first position 71A, a second position 71B, and a third position 71C by energizing or deenergizing a first solenoid 71D and a second solenoid 71E. When the boom control valve 71 is switched to the first position 71A, the hydraulic fluid is supplied to and discharged from the boom cylinder 32 so that the boom cylinder 32 is extended and the boom 31 swings upward. When the boom control valve 71 is switched to the second position 71B, the hydraulic fluid is supplied to and discharged from the boom cylinder 32 so that the boom cylinder 32 is retracted and the boom 31 swings downward.

The arm control valve 72 is a direct-operated spool-type switching valve capable of switching between a first position 72A, a second position 72B, and a third position 72C by energizing or deenergizing a first solenoid 72D and a second solenoid 72E. When the arm control valve 72 is switched to the first position 72A, the hydraulic fluid is supplied to and discharged from the arm cylinder 42 so that the arm cylinder 42 is extended and the arm 41 swings in the arm crowd direction D1. When the arm control valve 72 is switched to the second position 72B, the hydraulic fluid is supplied to and discharged from the arm cylinder 42 so that the arm cylinder 42 is retracted and the arm 41 swings in the arm dump direction D2.

The bucket control valve 73 is a direct-operated spool-type switching valve capable of switching between a first position 73A, a second position 73B, and a third position 73C by energizing or deenergizing a first solenoid 73D and a second solenoid 73E. When the bucket control valve 73 is switched to the first position 73A, the hydraulic fluid is supplied to and discharged from the bucket cylinder 52 so that the bucket cylinder 52 is extended and the bucket 51 swings in the working-tool crowd direction D3 (shoveling direction). When the bucket control valve 73 is switched to the second position 73B, the hydraulic fluid is supplied to and discharged from the bucket cylinder 52 so that the bucket cylinder 52 is retracted and the bucket 51 swings in the dump direction D4.

The controller 60 includes a boom controller 61, an arm controller 62, a bucket controller 63, and controls the switching operations of the boom control valve 71, the arm control valve 72, and the bucket control valve 73. In other words, the controller 60 controls the movements of the boom 31, the arm 41, and the bucket 51. The controller 60 may be realized as a logic circuit (hardware) formed on an integrated circuit (IC chip) or the like or as software executed by a computer. When the controller 60 is realized as software, the above-described computer includes a recording medium, an arithmetic circuit, and a random access memory (RAM). The recording medium stores a program, which is the software for realizing the functions of the controller 60, and various data regarding the working machine 1 such that the program and data are readable by a computer. The arithmetic circuit is, for example, a central processing unit (CPU) that executes the above-described program. The above-described program and various data are loaded into the random access memory (RAM). The arithmetic circuit reads the program from the above-described recording medium and executes the program to realize the functions of the controller 60.

The operation devices 19L and 19R that are held by the operator during operation are connected to the controller 60. The operation devices 19L and 19R are both disposed near the operator's seat 6. Each of the operation devices 19L and 19R includes an operation lever 15 and a position sensor 16. The operation lever 15 is pivotable in forward, rearward, leftward, and rightward directions from a neutral position, and the position sensor 16 detects amounts by which the operation lever 15 is pivoted in the forward, rearward, leftward, and rightward directions from the neutral position (amounts of operation).

When, for example, the operator pivots the operation lever 15 of the operation device 19R forward or rearward, the amount by which the operation lever 15 is pivoted forward or rearward is input to the controller 60. The boom controller 61 (controller 60) switches the boom control valve 71 by energizing or deenergizing the first solenoid 71D and the second solenoid 71E in accordance with the direction and amount of pivoting of the operation lever 15. Thus, the boom controller 61 controls the swinging of the boom 31.

When the operator pivots the operation lever 15 of the operation device 19L forward or rearward, the amount by which the operation lever 15 is pivoted forward or rearward is input to the controller 60. The arm controller 62 (controller 60) switches the arm control valve 72 by energizing or deenergizing the first solenoid 72D and the second solenoid 72E in accordance with the direction and amount of pivoting of the operation lever 15. Thus, the arm controller 62 controls the swinging of the arm 41.

When the operator pivots the operation lever 15 of the operation device 19R leftward or rightward, the amount by which the operation lever 15 is pivoted leftward or rightward is input to the controller 60. The bucket controller 63 (controller 60) switches the bucket control valve 73 by energizing or deenergizing the first solenoid 73D and the second solenoid 73E in accordance with the direction and amount of pivoting of the operation lever 15. Thus, the bucket controller 63 controls the swinging of the bucket 51.

The boom angle sensor 91, the arm angle sensor 92, and the bucket angle sensor (working-tool angle sensor) 93 are connected to the controller 60. The boom angle sensor 91 detects a swing angle θ2 (swing position) of the boom 31. The arm angle sensor 92 detects a swing angle θ3 (swing position) of the arm 41. The bucket angle sensor 93 detects a swing angle θ4 (swing position) of the bucket 51 around the pivot 57 with respect to the distal end portion of the arm 41. In the present embodiment, potentiometers are used as the boom angle sensor 91, the arm angle sensor 92, and the bucket angle sensor 93. However, the sensors are not limited to this, and other angle sensors may instead be used. Alternatively, the strokes (extending positions) of the boom cylinder 32, the arm cylinder 42, and the bucket cylinder 52 may be detected, and the swing angles of the boom 31, the arm 41, and the bucket 51 may be calculated from the result of the detection.

Figure 3:
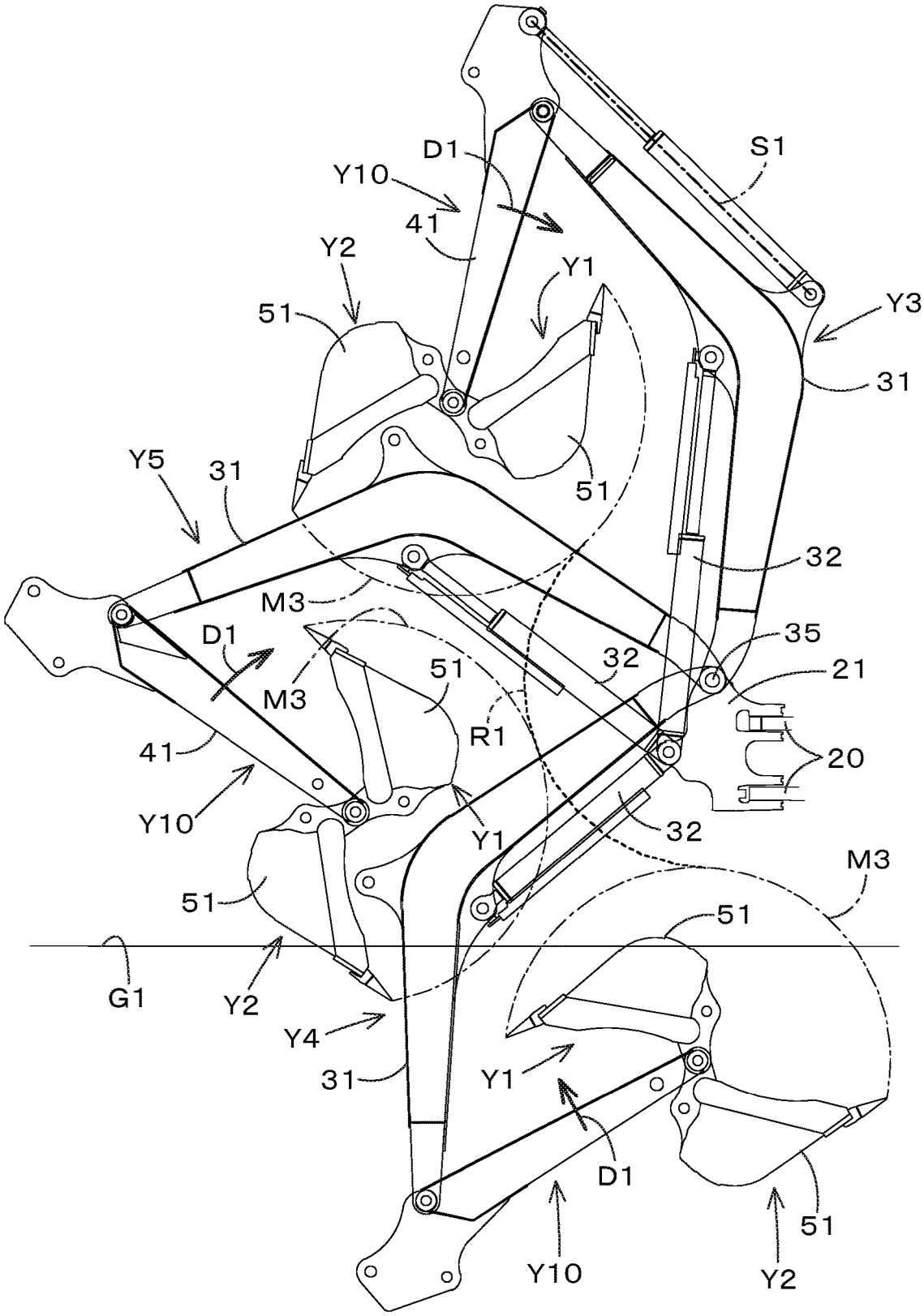
FIG. 3 illustrates the manner in which a swing position of a boom changes.

As illustrated in FIG. 2, the controller 60 also includes an arm crowd restricting unit 64. Referring to FIG. 3, the arm crowd restricting unit 64 restricts a stroke Si of the arm cylinder 42 in the arm crowd direction D1 so that the swing track M3 of the distal end portion 58 of the bucket (working tool) 51 is spaced from the boom cylinder 32 (from the cylinder guard when the cylinder guard is present). Thus, the distal end portion 58 of the bucket 51 can be prevented from interfering (coming into contact) with the boom cylinder 32.

FIG. 3 illustrates the boom 31 at different swing positions, the arm 41 at a limit position Y10 in the arm crowd direction D1, and the bucket 51 swung from the bucket crowd position Y1 to the bucket dump position Y2. A swing position Y3 is the uppermost position of the boom 31. A swing position Y4 is the lowermost position of the boom 31. A swing position Y5 is an intermediate position of the boom 31 between the uppermost position Y3 and the lowermost position Y4. In a region other than a region in which restriction on the stroke S1 is released as described below, the stroke S1 of the arm cylinder 42 in the arm crowd direction D1 is restricted (arm crowd restriction is imposed) so that the swing track M3 is spaced from the boom cylinder 32 (or cylinder guard). In FIG. 3, the dotted line R1 is a line that is in contact with the swing track M3 when the boom 31 swings between the uppermost position Y3 and the lowermost position Y4 while the arm 41 is at the limit position Y10.

Figure 5:
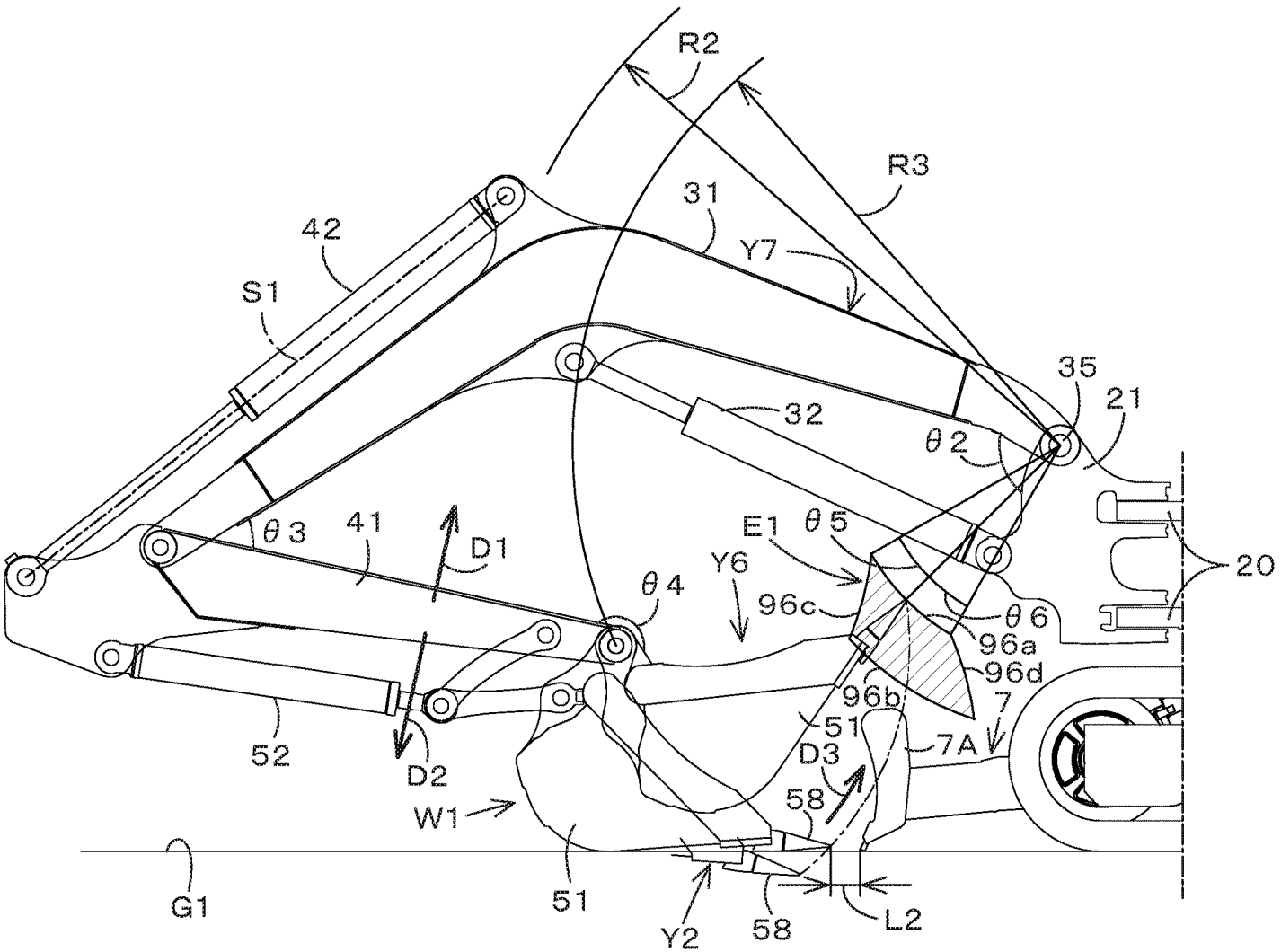
FIG. 5 illustrates the positional relationship between the bucket and the blade when the arm crowd restriction is released.

As illustrated in FIG. 2, the controller 60 also includes a crowd restriction releasing unit 65. When the working device 4 performs a specific operation, the crowd restriction releasing unit 65 releases the arm crowd restriction to enable an effective operation. More specifically, as illustrated in FIG. 5, when the boom 31 is at a swing position Y7 at which the bucket 51 in an operating position W1 close to the bucket dump position Y2 is disposed in the vicinity of a blade 7A, the restriction on the stroke S1 of the arm cylinder 42 is released to enable the arm 41 to swing to an end of a swing range of the arm 41 in the arm crowd direction D1.

The operation performed by the working machine 1 may be, for example, a so-called "collecting operation" in which dirt is scooped with the bucket 51 by using a front surface (blade surface) of the blade 7A of the dozer 7. In the "collecting operation", the bucket 51 is in the operating position W1 that is close to the bucket dump position Y2 (swing angle θ4 of the bucket 51 is beyond a set threshold toward the bucket dump position Y2) and in which the bottom surface 51*b* of the bucket body 51*a* faces downward (toward the ground surface G1) (see FIGS. 4 and 5).

Figure 4:
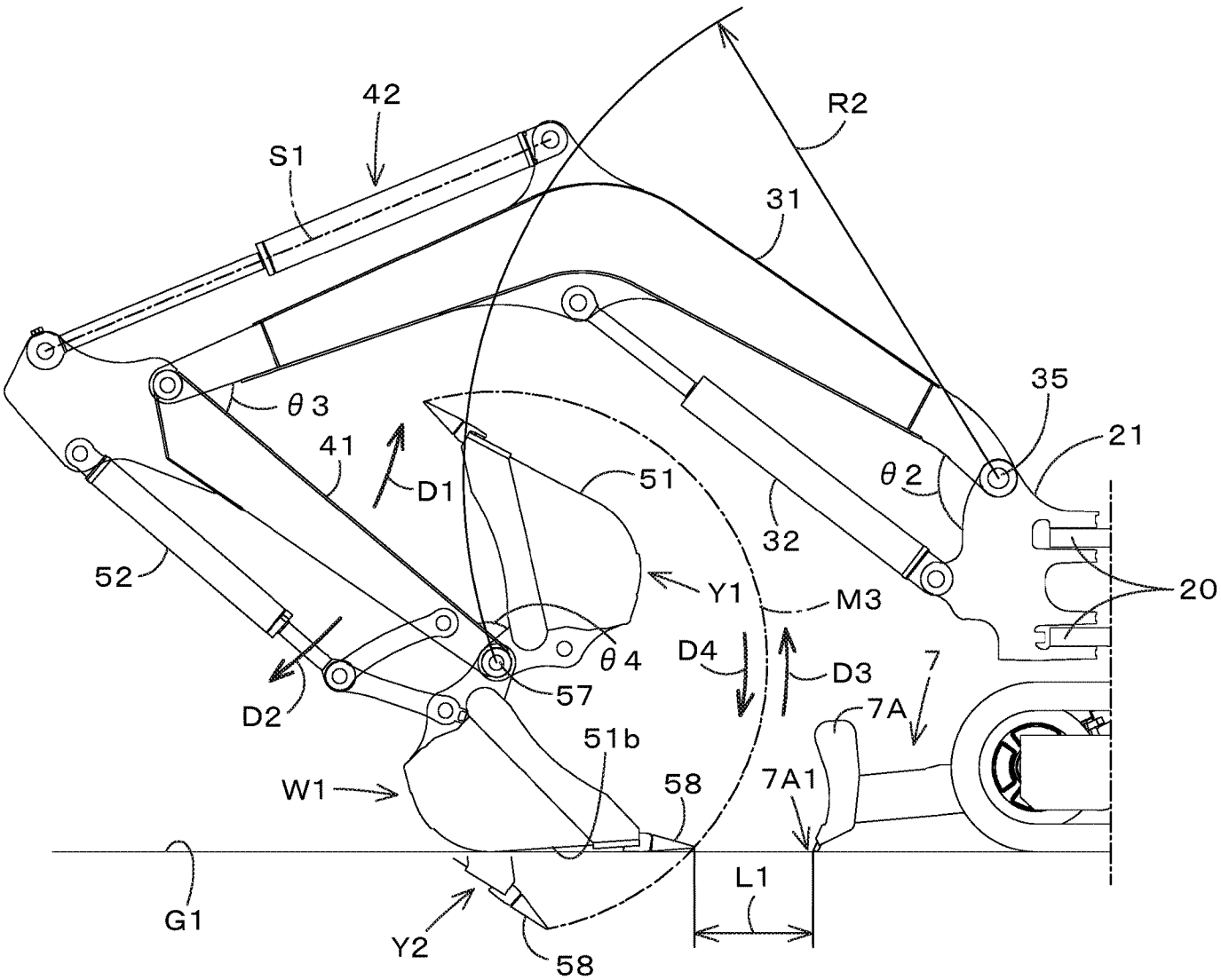
FIG. 4 illustrates the positional relationship between a bucket and a blade when an arm crowd restriction is not released.

FIG. 4 illustrates the "collecting operation" performed when the arm crowd restriction is imposed by the arm crowd restricting unit 64 over the entirety of the upward-downward swing region of the boom 31.

Referring to FIG. 4, in the case where the arm crowd restriction is imposed by the arm crowd restricting unit 64, when the arm 41 is swung to a position closest to the boom cylinder 32 and the boom 31 is lowered so that the bottom surface 51*b* of the bucket 51 in the operating position W1 is in contact with the ground surface G1, the distance between the distal end portion 58 and a blade edge 7A1 of the blade 7A is L1.

FIG. 5 illustrates the "collecting operation" performed when the arm crowd restriction is released by the crowd restriction releasing unit 65.

Referring to FIG. 5, in the case where the arm crowd restriction is released by the crowd restriction releasing unit 65, when the arm 41 is swung to a position closest to the boom cylinder 32 and the boom 31 is lowered so that the bottom surface 51*b* of the bucket 51 in the operating position W1 is in contact with the ground surface G1, the distance between the distal end portion 58 and the blade edge 7A1 of the blade 7A is L2 (minimum distance). The distance L2 is less than the distance L1. Thus, when the arm crowd restriction is released, the distal end portion 58 of the bucket 51 can be brought into the vicinity of the blade edge 7A1 of the blade 7A in the "collecting operation". Accordingly, the "collecting operation" can be effectively performed.

The crowd restriction releasing unit 65 releases the arm crowd restriction when the boom 31 is lowered until the swing angle θ2 of the boom 31 reaches a predetermined angle while the stroke S1 of the arm cylinder 42 in the crowd direction D1 is restricted. When the arm crowd restriction is released, the stroke S1 of the arm cylinder 42 in the crowd direction D1 can be increased to the end. Therefore, the arm 41 can be moved closer to the boom 31. Accordingly, a minimum distance R3 from the horizontal shaft 35 to the pivot 57 illustrated in FIG. 5 is less than a minimum distance R2 from the horizontal shaft 35 to the pivot 57 illustrated in FIG. 4, and the distal end portion 58 of the bucket 51 can be brought closer to the blade 7A by lowering the boom 31 (reducing the swing angle θ2).

Similar effects can also be obtained when a so-called "chipping operation" for breaking the floor or the like of a structure is performed. Thus, releasing of the arm crowd restriction is effective when the bucket 51 and the blade 7A work in cooperation with each other. In the present embodiment, the distance L2 between the distal end portion 58 of the bucket 51 and the blade edge 7A1 of the blade 7A is not zero. However, the distal end portion 58 of the bucket 51 may instead be brought into contact with the blade edge 7A1 of the blade 7A (distance L2=0).

As illustrated in FIG. 2, the controller 60 also includes a bucket crowd restricting unit (working-tool crowd restricting unit) 66. The bucket crowd restricting unit 66 restricts the swinging of the bucket 51 in the bucket crowd direction D3 when the restriction on the stroke 51 of the arm cylinder 42 is released by the crowd restriction releasing unit 65.

A swing position Y6 of the bucket 51 illustrated in FIG. 5 is a limit swing position to which the bucket 51 is swingable in the crowd direction D3 when the arm crowd restriction is released. More specifically, the bucket crowd restricting unit 66 restricts the stroke of the bucket cylinder 52 in the bucket crowd direction D3 so that the bucket 51 does not swing beyond the swing position Y6 in the bucket crowd direction D3.

Figure 6:
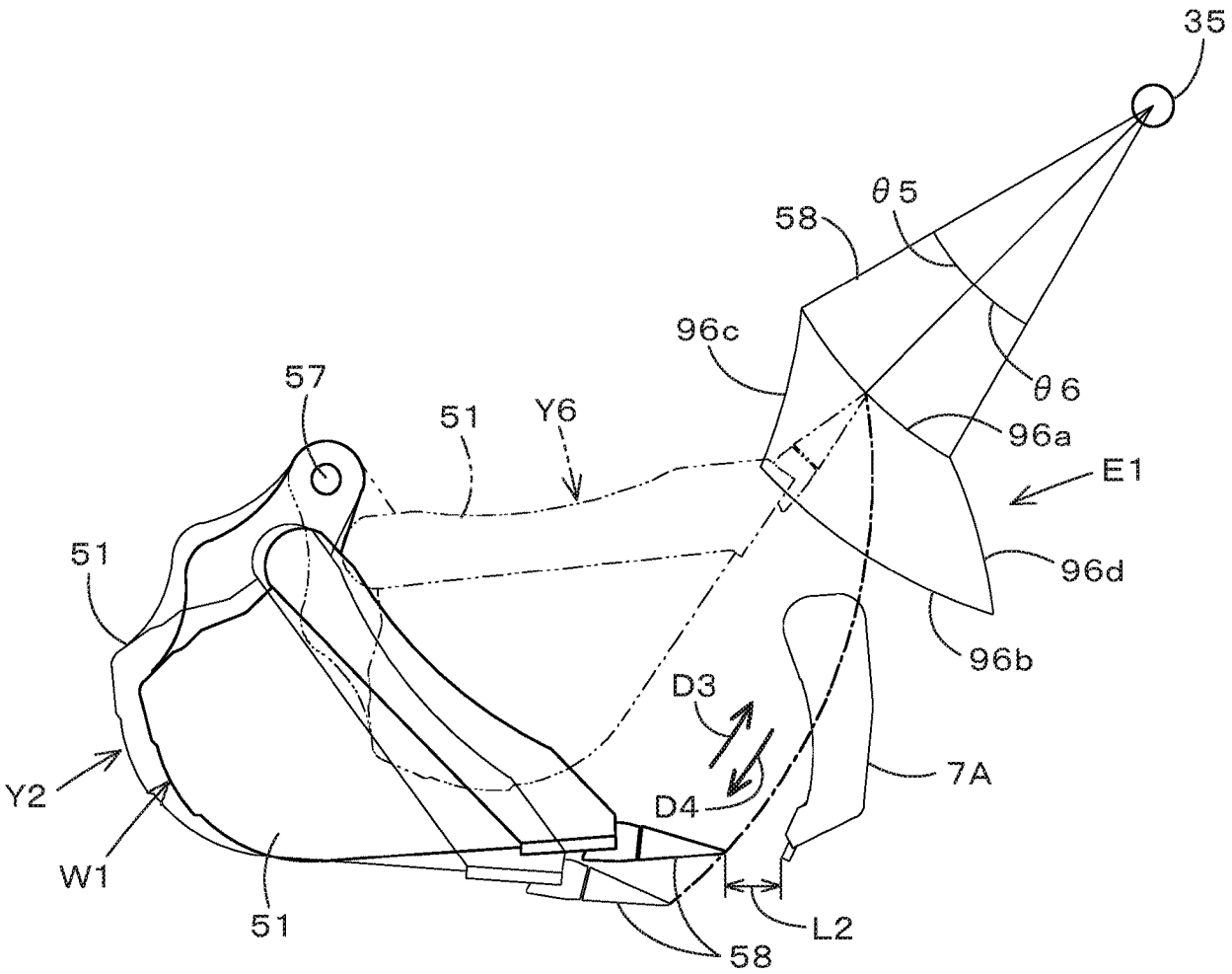
FIG. 6 is an enlarged view illustrating the positional relationship between the bucket and the blade.

A region E1 hatched in FIG. 5 is an increased working region that is included in a working area of the bucket 51 when the arm crowd restriction is released but not included in a working area of the bucket 51 when the arm crowd restriction is not released. As illustrated in FIG. 6, the region E1 is surrounded by first to fourth contour lines 96*a* to 96*d*. The first contour line 96*a* is a portion of a track along which the distal end portion 58 moves when the boom 31 is raised and lowered while the bucket 51 is at the swing position Y6. The second contour line 96*b* is a portion of the line R1 illustrated in FIG. 3. The third contour line 96*c* is a portion of a track along which the distal end portion 58 moves while the boom 31 is at a position shifted upward by a predetermined angle θ5 from the swing position Y7 (first swing position) illustrated in FIG. 5 at which the gap between the distal end portion 58 and the blade 7A is the minimum distance L2. The fourth contour line 96*d* is a portion of a track along which the distal end portion 58 moves while the boom 31 is at a position shifted downward by a predetermined angle θ6 from the first swing position Y7. This region E1 is a working region that is neither useful nor harmful.

Figure 7:
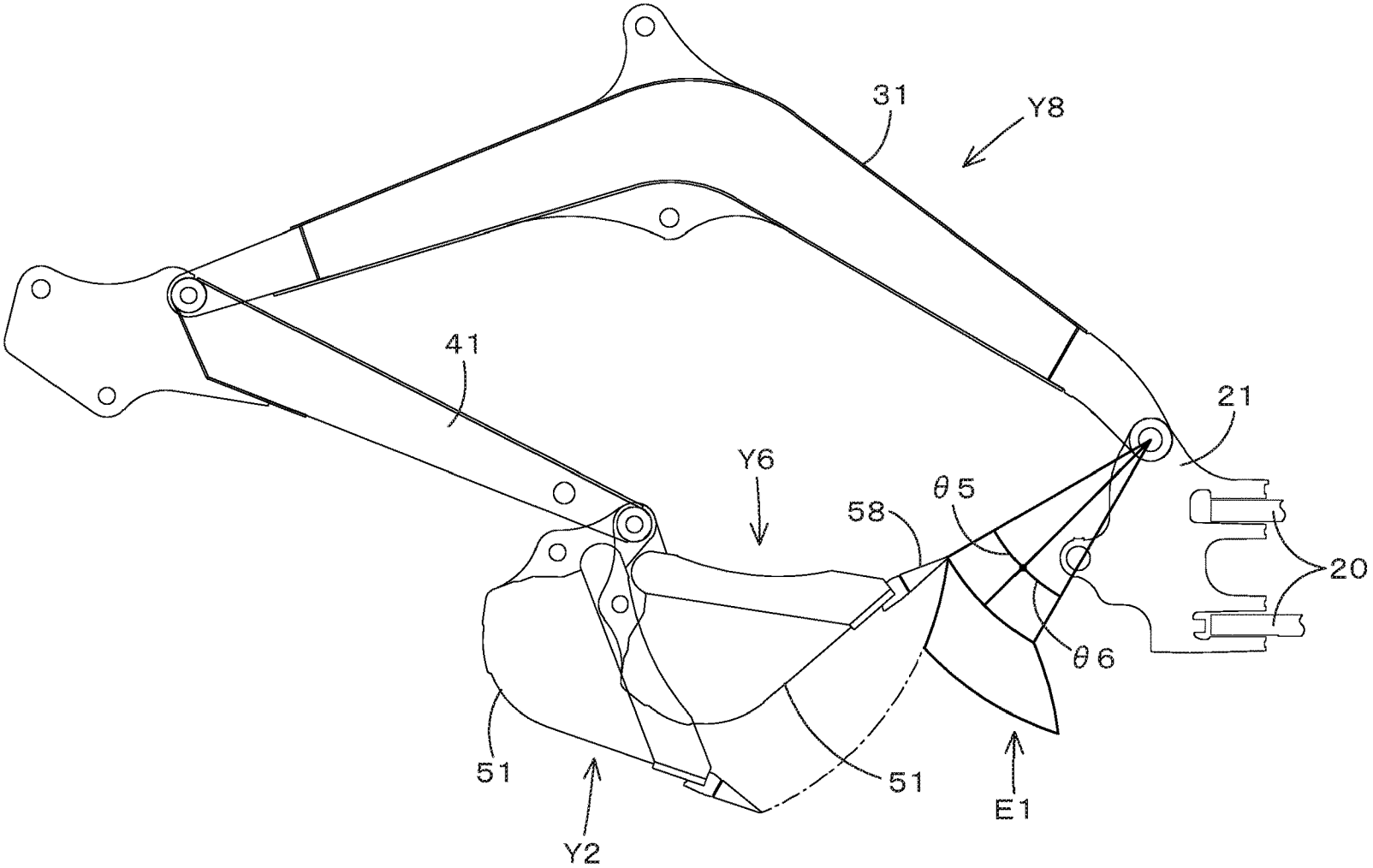
FIG. 7 is a side view of the boom raised from a first swing position to a second swing position.

FIG. 7 illustrates the boom 31 at a swing position (second swing position) Y8 shifted upward by the predetermined angle θ5 (for example, 15°) from the first swing position Y7.

When the boom 31 is raised from the first swing position Y7 to the second swing position Y8 while the arm crowd restriction is released, the boom controller 61 stops the upward movement of the boom 31 until the operator operates the arm 41 in the arm dump direction D2 and the arm 41 returns to a region in which the stroke of the arm cylinder 42 is not restricted. When the arm 41 returns to the region in which the stroke of the arm cylinder 42 is not restricted, the boom 31 is allowed to swing upward from the second swing position Y8. The arm crowd restriction is imposed when the boom 31 is in a swing region above the second swing position Y8.

Alternatively, when the boom 31 is raised from the first swing position Y7 to the second swing position Y8 while the arm crowd restriction is released, the arm controller 62 may cause the arm 41 to automatically return to the region in which the stroke of the arm cylinder 42 is not restricted.

Figure 8:
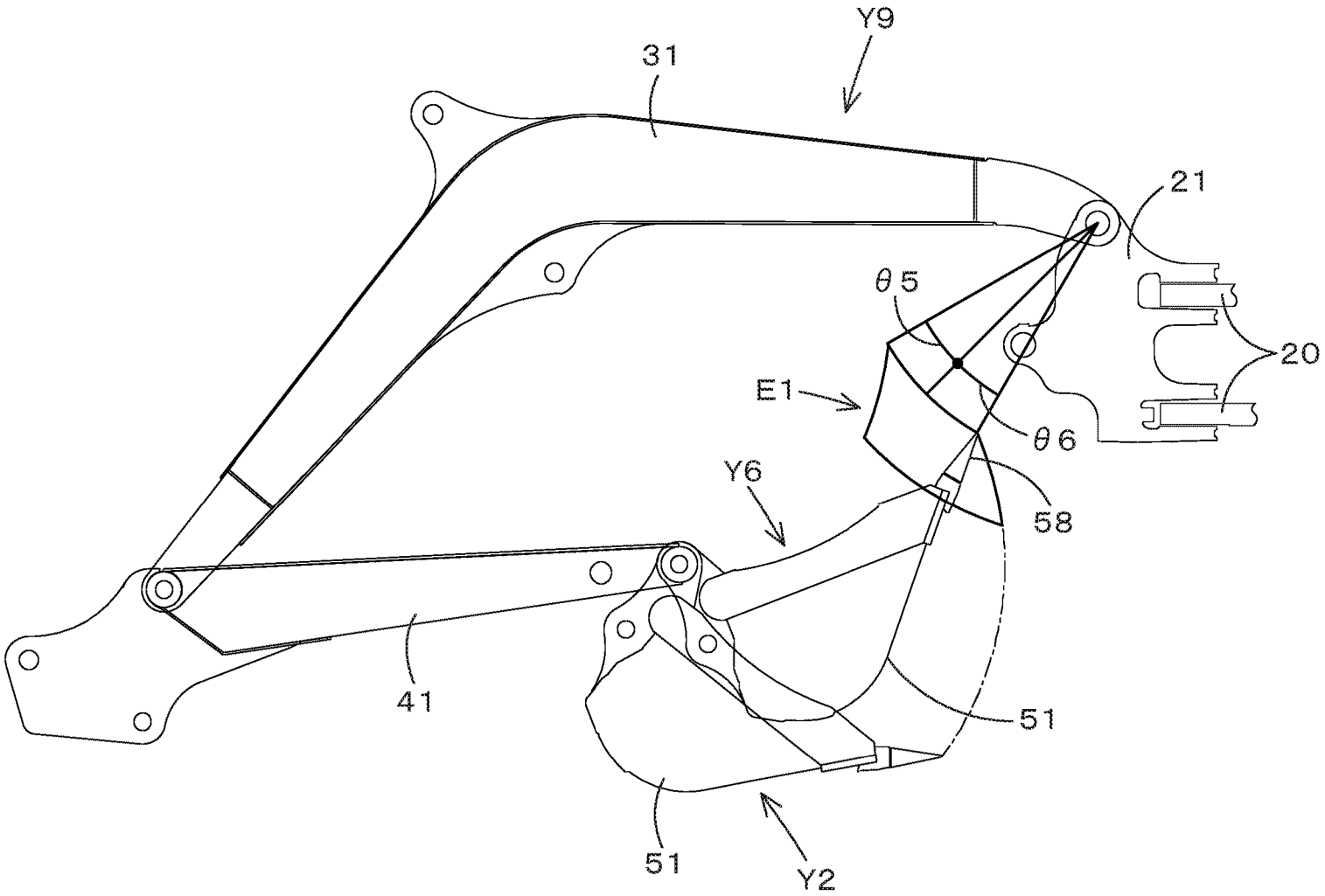
FIG. 8 is a side view of the boom lowered from the first swing position to a third swing position.

FIG. 8 illustrates the boom 31 at a swing position (third swing position) Y9 shifted downward by the predetermined angle θ6 (for example, 15°) from the first swing position Y7.

In this case, a control operation similar to that performed when the boom 31 is raised from the first swing position Y7 to the second swing position Y8 may be performed. More specifically, when the boom 31 is lowered from the first swing position Y7 to the third swing position Y9 while the arm crowd restriction is released, the boom controller 61 stops the downward movement of the boom 31 until the operator operates the arm 41 in the arm dump direction D2 and the arm 41 returns to the region in which the stroke of the arm cylinder 42 is not restricted.

Alternatively, when the boom 31 is lowered from the first swing position Y7 to the third swing position Y9 while the arm crowd restriction is released, the arm controller 62 may cause the arm 41 to automatically return to the region in which the stroke of the arm cylinder 42 is not restricted.

A lowering area toward which the boom 31 is lowered from the first swing position Y7 (lowering area of the boom 31) is not a working area in which a useful operation is enabled by releasing the arm crowd restriction. Therefore, the arm crowd restriction may instead be released in the entire lowering area of the boom 31.

The above-described working machine 1 includes the machine body 2, the dozer 7, the boom 31, the arm 41, the working tool 51, the boom cylinder 32, the arm cylinder 42, the arm crowd restricting unit 64, and the crowd restriction releasing unit 65. The dozer 7 includes the blade 7A. The boom 31 is pivotably supported by the machine body 2 such that the boom 31 is swingable upward and downward. The arm 41 is pivotably supported by the boom 31 such that the arm 41 is swingable in the arm crowd direction D1 toward the boom 31 and the arm dump direction D2 away from the boom 31. The working tool 51 is pivotably supported by the pivot 57 on the arm 41 such that the working tool 51 is swingable about the pivot 57 between the working-tool crowd position Y1 at which the distal end portion 58 is closest to the arm 41 and the working-tool dump position Y2 at which the distal end portion 58 is farthest from the arm 41. The boom cylinder 32 causes the boom 31 to swing and is disposed adjacent to a surface of the boom 31 that faces the arm 41 when the arm 41 swings in the arm crowd direction D1. The arm cylinder 42 causes the arm 41 to swing in the arm crowd direction D1 and the arm dump direction D2. The arm crowd restricting unit 64 imposes a restriction on the stroke Si of the arm cylinder 42 in the arm crowd direction D1 so that the swing track M3 of the distal end portion 58 of the working tool 51 is spaced from the boom cylinder 32. The crowd restriction releasing unit 65 releases the restriction on the stroke 51 of the arm cylinder 42 to enable the arm 41 to swing to the end of the swing range in the arm crowd direction D1 when the boom 31 is at a swing position at which the working tool 51 in the operating position W1 close to the working-tool dump position Y2 is disposed in the vicinity of the blade 7A.

According to this structure, when the working device 4 including the boom 31, the arm 41, and the working tool 51 is in an operating position in which the distal end portion 58 of the working tool 51 is close to the blade 7A, the distal end portion 58 of the working tool 51 can be positioned sufficiently close to the blade 7A. When the working device 4 is in other positions, the working tool 51 can be prevented from coming into contact with the boom cylinder 32.

The working machine 1 further includes the working-tool crowd restricting unit 66 that restricts swinging of the working tool 51 in a direction toward the working-tool crowd position Y1 when the restriction on the stroke S1 is released by the crowd restriction releasing unit 65.

According to this structure, even when the arm crowd restriction is released, the working tool 51 can be prevented from coming into contact with the boom cylinder 32.

The working machine 1 further includes the boom controller 61 that controls swinging of the boom 31. When the boom 31 is raised from the first swing position Y7, at which the gap between the distal end portion 58 of the working tool 51 and the blade 7A is the minimum distance L2, to the second swing position Y8 by a predetermined angle while the restriction on the stroke S1 is released by the crowd restriction releasing unit 65, the boom controller 61 stops raising of the boom 31 until the arm 41 returns to the region in which the stroke of the arm cylinder 42 is not restricted.

According to this structure, the working tool 51 can be prevented from interfering with the boom cylinder 32 in a swing region of the boom 31 above the second swing position Y8.

The working machine 1 further includes the arm controller 62 that controls swinging of the arm 41. When the boom 31 is raised from the first swing position Y7, at which the gap between the distal end portion 58 of the working tool 51 and the blade 7A is the minimum distance L2, to the second swing position Y8 by a predetermined angle while the restriction on the stroke S1 is released by the crowd restriction releasing unit 65, the arm controller 62 controls the arm 41 to return the arm 41 to the region in which the stroke of the arm cylinder 42 is not restricted.

According to this structure, the working tool 51 can be prevented from interfering with the boom cylinder 32 in a swing region of the boom 31 above the second swing position Y8.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

a dozer including a blade;

a boom including end portions one of which is pivotably supported by a front of the machine body such that the boom is swingable upward and downward;

an arm including end portions one of which is pivotably supported by the other of the end portions of the boom such that the arm is swingable in an arm crowd direction toward the boom and an arm dump direction away from the boom;

a working tool pivotably supported by a pivot on the other of the end portions of the arm such that the working tool is swingable about the pivot between a working-tool crowd position at which a distal end portion of the working tool is closest to the arm and a working-tool dump position at which the distal end portion of the working tool is farthest from the arm;

a boom cylinder that causes the boom to swing, the boom cylinder being disposed adjacent to a surface of the boom that faces the arm when the arm swings in the arm crowd direction;

an arm cylinder that causes the arm to swing in the arm crowd direction and the arm dump direction; and a controller that:

imposes a restriction on a stroke of the arm cylinder in the arm crowd direction so that a swing track of the distal end portion of the working tool is spaced from the boom cylinder while allowing the boom to swing upward and downward; and when the boom is lowered until a swinging angle of the boom reaches a predetermined angle while the stroke of the arm cylinder in the arm crowd direction is restricted, releases the restriction on the stroke of the arm cylinder to enable the arm to swing to an end of a swing range in the arm crowd direction;

wherein the predetermined angle is an angle at which the working tool in an operating position is disposed in a vicinity of the blade, the operating position being closer to the working-tool dump position than a predetermined swing position.

2. The working machine according to claim 1, wherein the controller restricts swinging of the working tool in a direction toward the working-tool crowd position when the restriction on the stroke of the arm cylinder is released by the controller.

3. The working machine according to claim 1, wherein, when the boom is raised from a first swing position, at which a gap between the distal end portion of the working tool and the blade is at a minimum, to a second swing position by a predetermined angle while the restriction on the stroke of the arm cylinder is released by the controller, the controller stops raising of the boom until an operator operates the arm in the arm dump direction and the arm returns to a region in which the stroke of the arm cylinder is not restricted.

4. The working machine according to claim 1, wherein, when the boom is raised from a first swing position, at which a gap between the distal end portion of the working tool and the blade is at a minimum, to a second swing position by a predetermined angle while the restriction on the stroke of the arm cylinder is released by the controller, the arm controller controls the arm to automatically return the arm to a region in which the stroke of the arm cylinder is not restricted and stops raising of the boom until the arm returns to the region in which the stroke of the arm cylinder is not restricted.

5. The working machine according to claim 1, further comprising:

a support bracket provided at the front of the machine body such that the support bracket projects forward from the machine body; and a swing bracket attached to the support bracket such that the swing bracket is swingable about an axis extending vertically;

wherein the one of the end portions of the boom is pivotably supported by the swing bracket such that the boom is swingable upward and downward.

6. The working machine according to claim 3, wherein after stopping raising of the boom, when the arm returns to the region in which the stroke of the arm cylinder is not restricted, the controller allows the boom to swing upward from the second swing position and imposes the restriction on the stroke of the arm cylinder in the arm crowd direction when the boom is in a swing region above the second swing position.

7. The working machine according to claim 4, wherein after stopping raising of the boom, when the arm returns to the region in which the stroke of the arm cylinder is not restricted, the controller allows the boom to swing upward from the second swing position and imposes the restriction on the stroke of the arm cylinder in the arm crowd direction when the boom is in a swing region above the second swing position.

* * * * *